US005222569A

United States Patent [19]

Martel

[11] Patent Number: 5,222,569

[45] Date of Patent: Jun. 29, 1993

[54] PROPULSION MEANS

[76] Inventor: Yvon Martel, 4892 Chemin St-Isidore, Laterrière, Quebec, Canada, G0V 1K0

[21] Appl. No.: 819,878

[22] Filed: Jan. 13, 1992

[30] Foreign Application Priority Data

Jan. 15, 1991 [CA] Canada ..... 2034191

[51] Int. Cl.[5] ..... A63C 5/08

[52] U.S. Cl. ..... 180/180; 180/7.4

[58] Field of Search ..... 114/315; 440/37; 244/4 R, 23 A, 903; 180/180, 181, 182, 7.1, 7.3, 7.4; 280/809

[56] References Cited

U.S. PATENT DOCUMENTS

| | | | |
|---|---|---|---|
| 2,456,440 | 12/1948 | Morrill | 180/180 |
| 3,750,777 | 8/1973 | Thompson | 180/180 |
| 4,096,919 | 6/1978 | Thompson | 180/180 |
| 4,189,019 | 2/1980 | Zech | 180/182 |
| 4,260,036 | 4/1981 | Bissett | 180/180 |
| 4,508,187 | 4/1985 | Wenzel | 180/181 |
| 4,519,470 | 5/1985 | Allisio | 180/180 |

FOREIGN PATENT DOCUMENTS

| | | | |
|---|---|---|---|
| 1203821 | 4/1986 | Canada | 180/180 |
| 329582 | 9/1935 | Italy | 180/180 |

*Primary Examiner*—Margaret A. Focarino
*Assistant Examiner*—Michael Mar
*Attorney, Agent, or Firm*—Ronald S. Kosie; Robert Brouillette

[57] ABSTRACT

The present invention generally relates to a propulsion apparatus for imparting thrust to a person. The propulsion apparatus is configured so as to be disposed or mounted on the user such that the thrust is transmitted to the rear of the user's pelvic area. The propulsion apparatus may, for example, include a motor which is connected to a propeller for providing forward thrust. The propulsion, apparatus may, in particular, be used in association with skis for travelling over a snow covered surface; however, it may be used in association with other similar or analogous devices for travel over the same or other surfaces.

13 Claims, 8 Drawing Sheets

PROPULSION MEANS

FIELD OF THE INVENTION

The present invention relates to a propulsion apparatus and more particularly to a self-propelled unit to impart thrust to a person, e.g. to be used to propel a person equipped with suitable travel means, such as skis, skates or the like.

DESCRIPTION OF PRIOR ART

Various forms of self-propelled units or similar units have been previously suggested for enabling a person such as a skier or a skater to overcome a rising path or simply to displace himself or herself from one place to another.

However, such units have not been provided with the necessary characteristics to allow the user to use same efficiently and more particularly same were too complicated to use.

For example, reference is made to U.S. Pat. No. 4,189,019 (Zech) in which a back pack style propulsion unit is disclosed. Despite the fact that this device is provided with variable thrust means, same is difficult to control since the thrust generated by the engine is transmitted to the upper back of the user, which causes an undesirable forward movement of the upper body of the user which must be compensated by an opposed upper body muscular activity on the part of the user (which over a period of time becomes uncomfortable).

Furthermore, the complexity of the means to vary the trust may cause a problem in certain situations.

U.S. Pat. No. 4,260,036 (Bissett) discloses a powered ski incorporating a power unit and an upright chassis which is articulated to a runner. The steering means on this powered ski is also complicated and requires a certain amount of time to master. The powered ski also bulky and cumbersome to transport.

U.S. Pat. No. 2,456,440 (Morrill) shows a propelling device mounted to a skater. This configuration presents certain drawbacks such as the size of the device and the position of the fuel tank.

OBJECTS OF THE PRESENT INVENTION

An object of the present invention is to provide a propulsion means which is economical to use.

Another object of the present invention is to provide a light weight and safe propulsion means.

Still another object of the present invention is to provide an improvement in such propulsion means in which the thrust is applied to the lower portion of the back or the pelvic area of the user.

Yet another object of the present invention is to provide a propulsion means which can be advantageously used by a skier in order to overcome an upward snow path or can be used by said skier or a skater to displace himself or herself from one place to another.

SUMMARY OF THE INVENTION

In general, the present invention provides an efficient self propelled apparatus which transfers the thrust developed by the apparatus to the lower portion of the back or the pelvis area of the user. For the purposes of the present invention, the expression "rear of the pelvic area" or the like in relation to a person, shall be understood as referring to the lower back of a person associated with the pelvis.

Thus, in accordance with a general aspect of the present invention, there is provided a propulsion apparatus for imparting thrust to a person, said thrust being transmitted solely to the rear of the pelvic area of said person, said propulsion apparatus comprising:

a support means for abutting solely the rear of the solely the rear of the pelvic area of the person;

a power-operated means mounted to said support means;

propelling means operatively connected to said power-operated means; and thrust variation means connected to said power-operated means.

In accordance with a particular aspect, the present invention provides a propulsion apparatus as defined above which includes securing means for securing said support means to said person such that the thrust imparted by said propulsion apparatus is transmitted solely to the rear of the pelvic area of said person.

The apparatus of the present invention may be used by a person in conjuction with, for example, any suitable travel means which normally relies on gravitational or manual forces for propelling the person. The travel means may, for example, be a means for traveling over a surface such as a water, snow, or ice surface, earthen surfaces, road surfaces and/or the like. Thus, the apparatus may be used to propel a person equipped with suitable surface travel means, such as snow skis, ice skates, roller skates, skate boards or the like (gliding or rolling means); other types of similar or analogous travel means may possibly also be used including water skis, skate boards, unicycles, etc.; in any event, the travel means used must be such that it cooperates with the apparatus of the present invention so as to propel the person. For the purposes herein, the expression "surface travel means" shall be understood as referring to surface travel means as mentioned above.

In accordance with the present invention, the power-operated means may comprise a motor having a shaft and the propelling means may comprise a propeller mounted to said shaft. The power-operated means may further include foot-activated starting means. The thrust variation means, on the other hand, may include hand operable means for shutting off the power-operated means; any conventional mechanism for shutting off a particular type of motor may of course be used. The provision of foot activated starting means may be used to facilitate the starting of the apparatus once the apparatus is in place adjacent a person's back pelvis area.

Thus, for example, the power-operated means may comprise a motor which is an internal combustion motor and the power-operated means may also include a fuel tank for such motor. In this case the power-operated means may further include foot-activated recoil starting means; i.e. recoil starting means such as are used, for example, for starting internal combustion motors incorporated into lawn mowers or into outboard motors of small pleasure boats. The thrust variation means may include the above mentioned hand operable means for shutting off such power-operated means; in this case, for example, the gas/air mixture from the carburator may be choked off in any conventional or suitable manner. Thrust variation means such as decompresser and choke control means may, for example, be controlled by a suitable button mechanism located on a single handle means (if present).

If an internal combustion engine is used along with a propellor for the apparatus, the power-operated means may include muffler means having an exhaust discharge outlet means, the muffler means being advantageously configured and disposed such that exhaust discharge is directed toward the propellor. The disposition of the discharge outlet toward the propellor means is for the purpose of further attenuating motor noise, i.e. exhaust discharge is broken up by the propellor. In accordance with the present invention the muffler and the support means may also be comprised in one single structure; two separate structures can still of course be used if so desired.

As a safety feature of the present invention the propulsion apparatus may include cowling cage means mounted to the support means, the power-operated means and the propelling means being disposed within said cage. A motor and propeller assembly as mentioned above may, for example, be disposed within such a cowling cage means. The fuel tank may also, for example, be incorporated into the body of a cage structure; e.g. a part of the cage structure for protecting a propellor.

In accordance with the present invention, the thrust variation means may, if desired, include handle means mounted to the support means for pivotal movement relative to the support means, the pivotal movement consisting of up and down movement (i.e. when the apparatus is mounted on a person, the person may raise and lower the handles); the handle means may be configured to extend from the support means to a position in front of and to the side of the abdominal area of the person.

In accordance with the present invention the securing means may, for example, advantageously comprise a pendulum shoulder harness. A pendulum shoulder harness may, for example, comprise at least two shoulder straps; one end of each of the straps is disposed about or connected to a respective shoulder area of the user while the other ends of the straps are connected to the apparatus. The harness may, however, have only one connector element (e.g. a common strap element) connecting it to the apparatus. The harness may also be directly or indirectly attached to the support means in any convenient manner. The elements of the harness may be connected, at one or more points, to the apparatus. However, the fixation of the harness to the apparatus is such that the apparatus is vertically supported by the user's shoulders and the support means is not fixed relative to the lower back or pelvic area of the user. The apparatus is thus free to swing from side to side and to be pivoted by the user about the pelvic area (i.e. by handle means as described herein). The pendulum shoulder harness provides the user with significant control with respect to equilibrium, direction of travel, etc.; additionally, since the apparatus is not attached to the pelvic area, this facilitates disengagement of the user and machine, should the user fall. It shall be understood that, as used herein, the expression "pendulum shoulder harness" shall have the above described meaning. Any other means of securing the apparatus to a user may of course be used provided that the apparatus is secured to the person such that thrust is transmitted to the rear pelvic area of the person.

In accordance with the present invention a variable pitch propeller may be provided in which case the thrust variation means may include variable pitch control means; the variable pitch control means may, for example, be mounted on handle means such as mentione above.

Thus in accordance with a further particular aspect the present invention provides a propulsion apparatus wherein the thrust variation means includes handle means mounted to the support means for pivotal movement relative to the support means, the pivotal movement consisting of up and down movement, the handle means being configured to extend from the support means to a position in front of and to the side of the abdominal area of the person, and the propelling means includes a propeller provided with variable pitch control means and the pitch control means is mounted on the handle means.

The present invention thus provides a simple propulsion means for imparting thrust to a user; the means being relatively easy to control. The apparatus facilitates directional control since complex steering means is not a requirement. Additionally, for example, if an internal combustion engine is used it may be started or activated by a starting rope, preferably utilizing the foot of the user. The elements of the apparatus such as the motor and fuel reservoir may, for example, if desired, be disposed or confined within a cowling cage means or frame structure, so as to increase the safety of the propulsion apparatus. Thus a propeller may protected by a protective but compact cage; the protective cage and the fuel tank, for example, be unitary.

DESCRIPTION OF DRAWINGS

In drawings which illustrate example ebodiments of the present invention.

DETAILED DESCRIPTION

Figure 1:
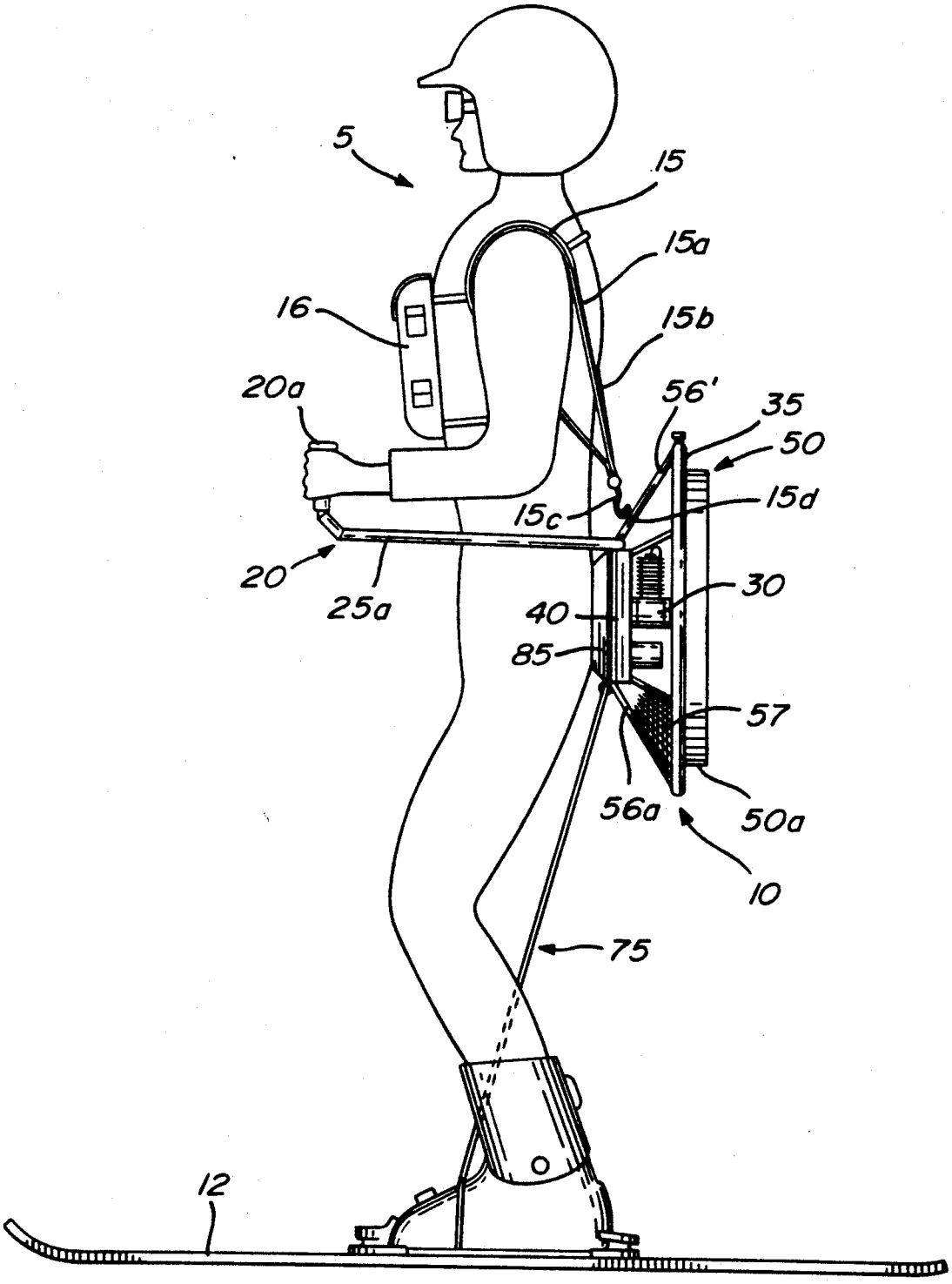
FIG. 1 a side elevational view of a skier using an example embodiment of a propulsion apparatus of the present invention.

FIG. 1 shows a skier 5 wearing snow skis and using the propulsion apparatus of the present invention. The self-propelled unit, generally referred to as numeral 10, is worn in the manner of a back pack. The unit 10 is secured to the user or skier 5 by securing means which for this embodiement is shown as having the form of a pendulum shoulder harness 15. The pendulum shoulder harness 15 has two shoulder strap members 15*a* and 15*b*; these shoulder strap members are connected at the ends thereof to the attachment hook 15*c*. The attachement hook 15*c* releasably engages an eyelet member 15*d*. The pendulum shoulder harness 15 may as shown have chest and/or back cross members. The pendulum shoulder harness 15 can also as shown accommodate a front sack 16. The user 5 is shown as wearing snow skis 12; however the skis may be replaced by skates, a skate board or the like (not shown).

The unit 10 comprises generally a power-operated means such as an internal combustion motor 30, an energy storage means such as a fuel tank 35, a muffler-support structure 40, a propelling means such as a propeller 45 (see FIG. 2) and cowling cage means 50; the cage or shroud 50 protects, for example, the propellor, motor, etc.. In the example embodiment shown, the fuel tank 35 is incorporated into the structure of the protective cage 50 which also has a collar 50*a*; the fuel tank 35 forming part of a propellor protection means.

At least part of the motor functions may be controlled by the user via the handle means referred to generally by the reference number 20.

Figure 2:
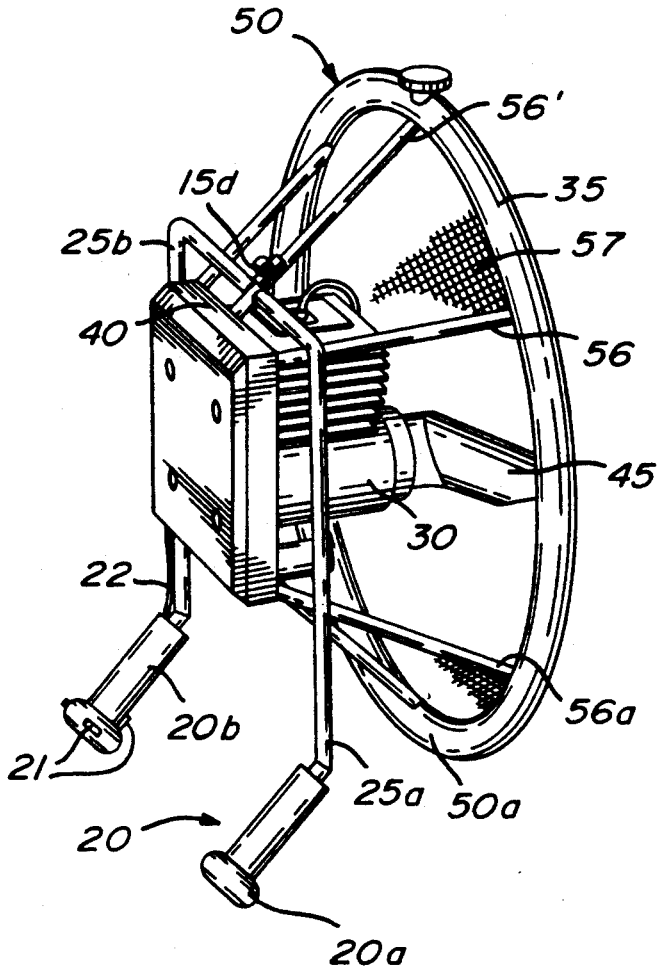
FIG. 2 is a perspective view of the propulsion apparatus shown in FIG. 1.

Referring to FIG. 2, the handle means 20 includes hand grip members 20*a* and 20*b* as well as stem members 25*a* and 25*b*. The stem members 25*a* and 25*b* are pivotably connected to the rod 56' so that they may be displaced up and down but not side to side; the rod 56' is fixed to the muffler-support means 40. In FIG. 1, the handle means 20 is shown in an up position at the sides of the person with the hand grip members being in front of the abdominal area of the user; in FIG. 2 it is shown in a down position. In the embodiment shown the stem members are fixed together (see FIG. 4) at their ends (i.e. by being welded, by being integral, etc. . . .) and the area of connection passes through a hole in the rod 56'; this hole rotatably embraces said area of connection such that there is only said up and down movment of the handle means 20. The pivot joint may alternatively be accomplished by use of a u-shaped bracket, the stems being interconnected and the u-shape enbracing them; by the use of a "t"-shape rod member fixed to or integral with the rod 56' whereby the ends of the stems are rotatably joined to the arms of the "t"; etc. . . . The handle means 20 may alternatively be directly joined to the muffler-support structure 40 in such pivotal manner.

It is possible to adjust the motor rotational speed by incorporating into a grip member (e.g. grip member 20*b*) suitable controlling means 21 which are operatively connected to the power-operated means; the grip member may also comprise a shut-off ignition switch (not shown). The speed controlling means 21 may comprise a flexible cable 22 (FIG. 2) connected to the motor fuel supply line, if the motor used is an internal combustion engine. An internal combustion engine is (as mentioned above) shown in FIG. 1 and in more detail in FIGS. 4 and 5. Since motor controlling means for such engines are well known in the art, same will not be described in further detail.

A two stroke combustion engine may be used for the apparatus, the motor developing about 8 HP at 8000 rpm and weighing about 8 pounds. The motor may have one or more cylinders. As an example, the Homelite 100 cc motor for mechanical saws may be used, the support structure being configured to anchor the motor thereto.

Figure 4:
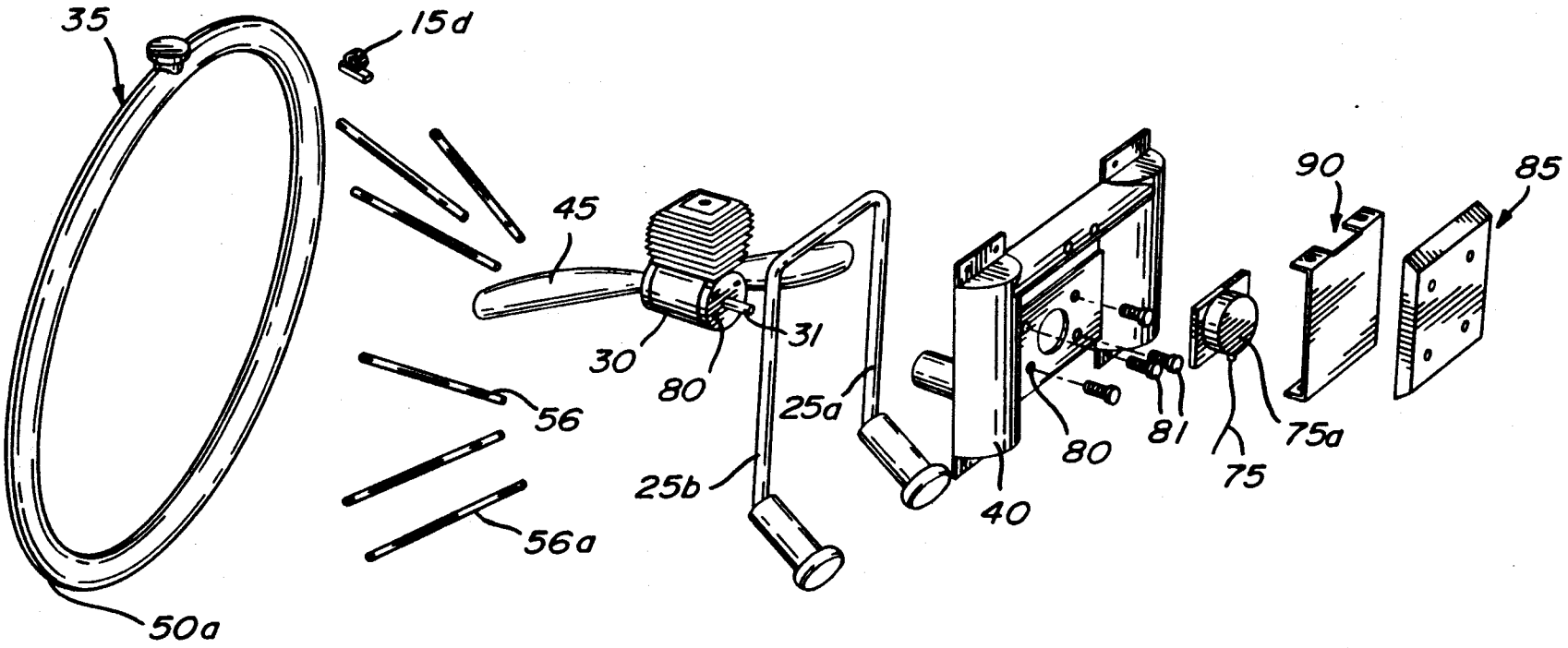
FIG. 4 is an exploded perspective view of the propulsion apparatus shown in FIG. 2.
Figure 5A:
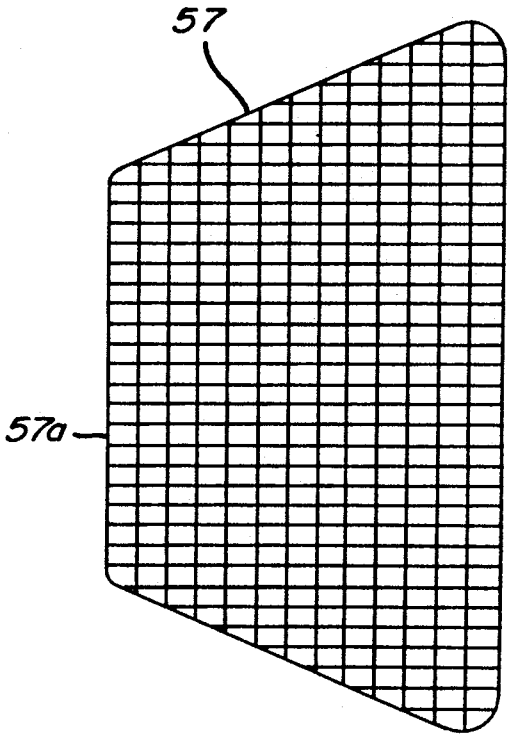
FIG. 5*a* is a side view of a protective screen or netting.
Figure 5:
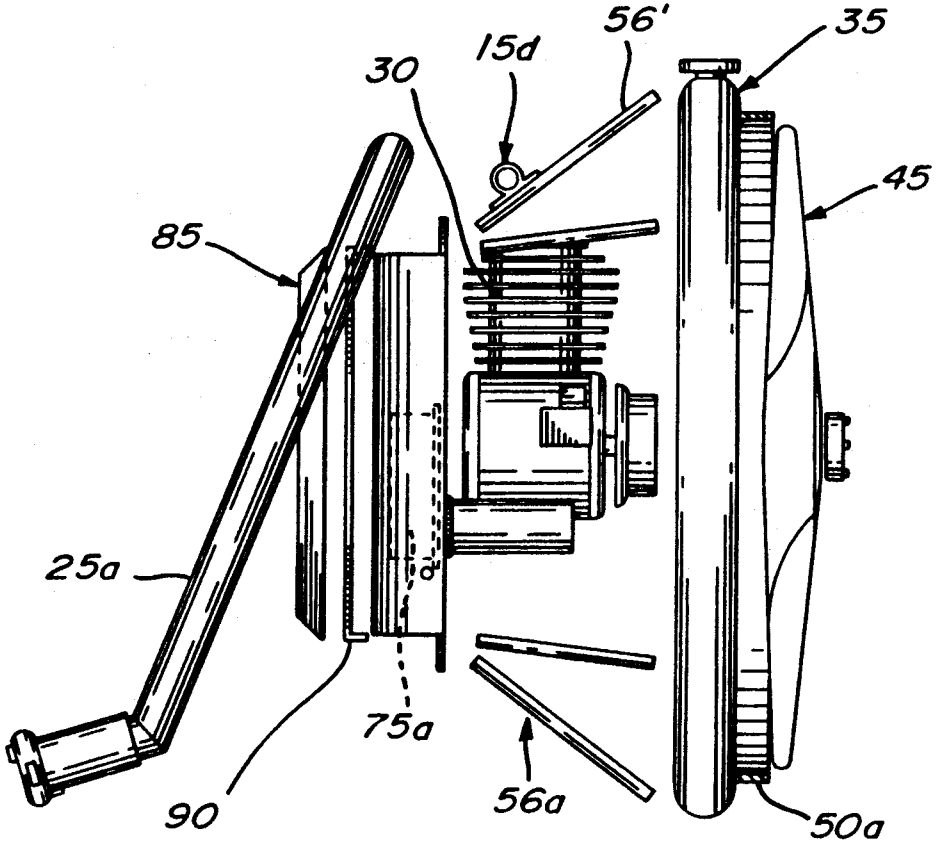
FIG. 5 is a partially exploded side elevational view of the propulsion apparatus shown in FIG. 2

Referring to FIGS. 2, 4 and 5, the motor 30 is secured to the muffler-support structure 40; in this embodiment the muffler has a dual role, namely, that of a support means and as muffler means.

Still referring to FIGS. 2, 4 and 5, the propulsion unit is provided with cowling cage means 50. The cage structure 50 comprises a plurality of rods (designated by the general base reference numeral 56), the annular fuel tank 35 and the collar 50*a*; rods 56 (including rods 56' and 56*a*), fuel tank 35 and the collar 50*a* can be respectively secured to each other by appropriate means such as welding or the like. The cage structure 50 is fixed to the muffler-support structure 40 via the rods 56 by some appropriate fixation means such as welding etc. . . . As may be seen, the fuel tank 35, the muffler and the engine 30 are confined or disposed within said cowling cage means 50 so as to provide a safer unit; i.e. the fuel tank 35 forms part of the structure of the cowling cage means 50 whereas the muffler forms part of the support means around which the cage is disposed.

Figure 3:
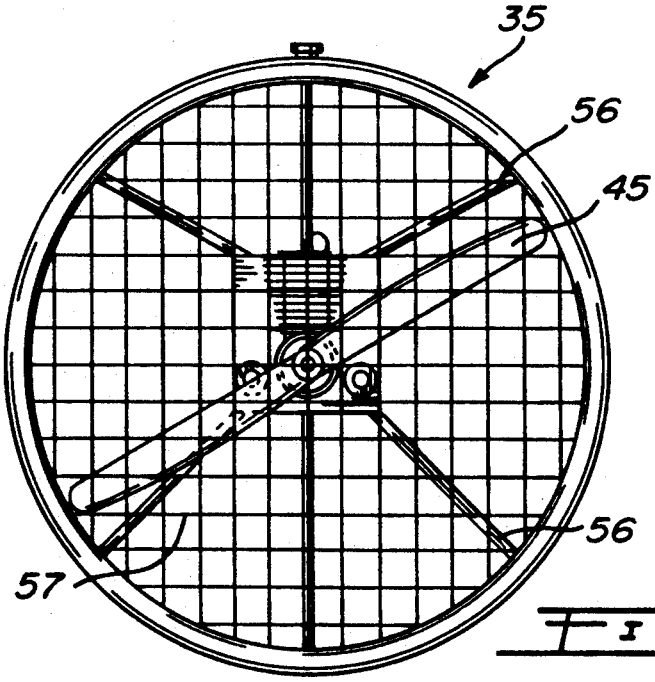
FIG. 3 is a rear view of the propulsion apparatus shown in FIG. 2.

A propeller screen or netting 57 may be disposed over the cage structure in the manner of a sock (FIG. 5*a*) using opening 57*a*. The propeller screen 57 is supported by the rods 56 and is used to cover the larger spaces therebetween and also covers the rear end of the unit as shown in FIG. 3.

The lower rod 56*a* (see FIG. 1) may be hollow so as to be used as part of the fuel supply line for the engine 30.

An eyelet 15*d* is provided on the upper rod 56' (as mentioned above) for transportation and mounting purposes.

It should be noted that, in the foregoing embodiment, although a gasoline engine is employed for the unit 10, an electric motor may be employed by substituting a battery for the fuel tank 35.

FIG. 4 shows an exploded view of the assembly of the unit 10. As shown, the fuel tank 35 is secured to the muffler-support structure 40 by means of the plurality of rods 56. The engine 30 is secured to the muffler-support structure 40 by means of securing means such as bolts 81 which pass through the openings 80 provided into said structure 40 and then on to corresponding attachement openings in the motor.

In the assembled configuration, the modular components cooperatively define a sturdy propulsion means construction adapted for substantially trouble free use. However, in the disassembled state, the individual modular components have a generally lightweight construction adapted for relatively easy lifting and handling and for transport within a compact volumetric space.

Still referrring to FIG. 4, reference numeral 75 represents the starting cable which is operatively connected to a recoil starter mechanism 75*a* such as is used on outboard motors for pleasure boats. The recoil starter 75*a* is connected to the propelling shaft 31 of the engine 30 in a conventional manner; the propellor 45 is mounted in a conventional manner to the opposite end of the shaft 31.

In the illustrated embodiment, the starting cable 75 is foot operated rather than hand operated (see FIG. 1). In this manner, the user can keep both hands free for other uses (e.g. on the handle means 20 so as to control the unit 10).

A soft padding 85 is connected to and positioned on the front side of the muffler-support structure 40 for engaging the pelvic area of the user. Additionally, a heat barrier 90 is placed between the soft padding 85 and the muffler-support structure 40. The propeller shaft has an axis of rotation which extends through the padding 85 and the pelvic area of the user as shown in FIG. 1.

All the elements shown in FIG. 4 are connected together by any appropriate manner such as bolting, welding or the like.

Figure 6:
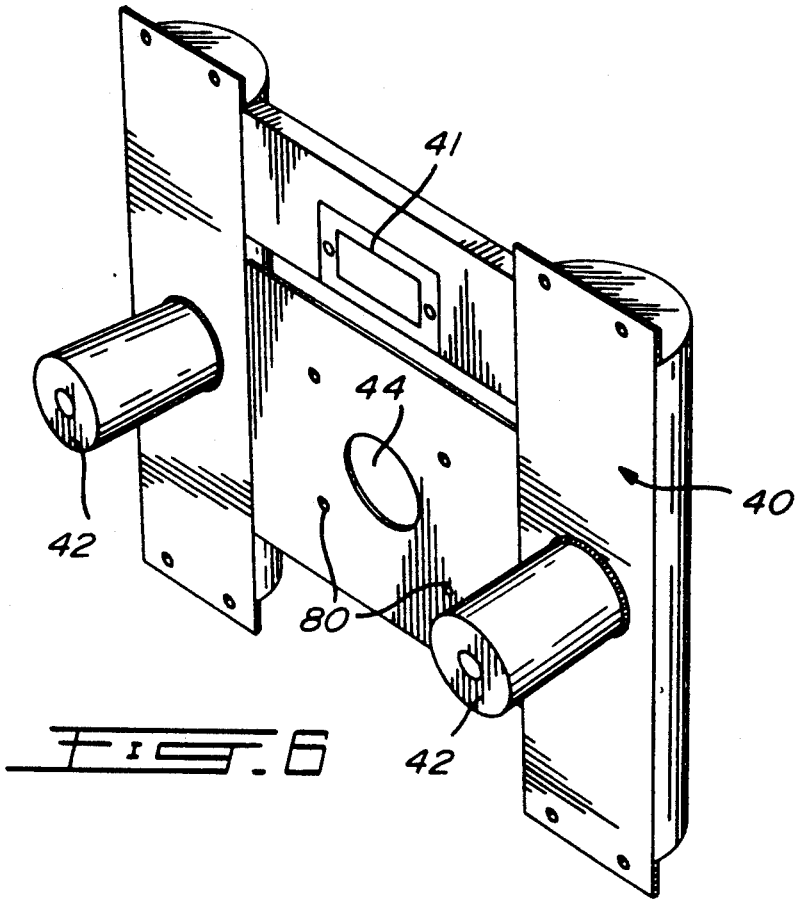
FIG. 6 is a perspective view of a muffler-support structure in accordance with the present invention.
Figure 7:
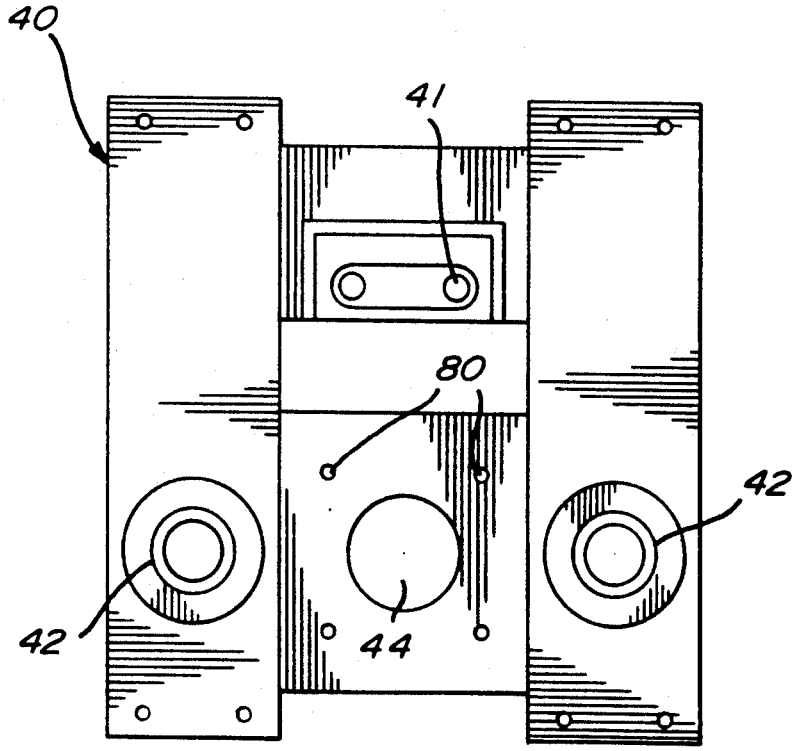
FIG. 7 is a front elevational view of the muffler-support structure shown in FIG. 6.

FIGS. 6 and 7, illustrate the muffler-support structure 40. The muffler-support structure 40 comprises an exhaust manifold 41 communicating with two exhaust pipes 42; the interior of the muffler comprising usual muffler baffle structures. The exhaust manifold 41 may be secured to the motor 30 in a conventional manner, i.e. by the opening 80 and bolts 81 or by any other appropriate means. The muffler structure 40 is provided with an opening 44 for the engine shaft 31 (see FIG. 4).

In order to reduce the vibration which may be caused by the motor 30, the motor may be mounted to the muffler-support structure 50 through any type of suitable vibration absorbing means so as to limit, to a minimum, direct transmission of the vibration to the user 5.

As described earlier, the reference number 75 indicates the engine starting cable, thus, when the user wishes to start the engine, a simple movement of the foot is necessary for that purpose.

Direction changes may be made simply by the usual method in skiing, namely by shifting the weight of the skier from one ski to the other or by changing the direction or orientation of the skis. Therefore, no complex steering mechanism is necessary; this enhances the freedom of movement of the user. However, in order to facilitate turns and/or regain equilibrium recourse may be made to any handle means (such as described above) which if desired, may be present, so as to pivot the unit about the pelvic area and thus direct the direction of thrust.

Figure 8:
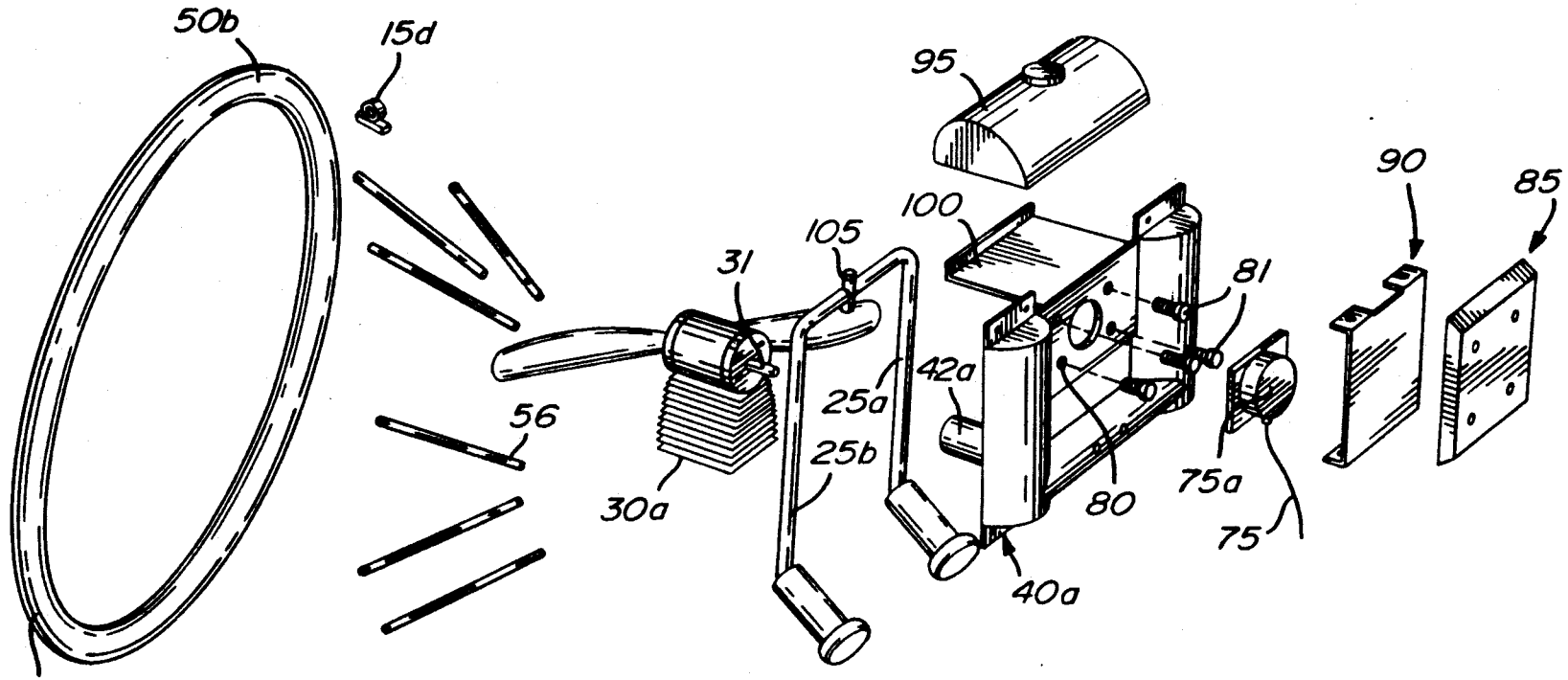
FIG. 8 is an exploded perspective view of another embodiment of a propulsion apparatus in accordance with the present invention.
Figure 9:
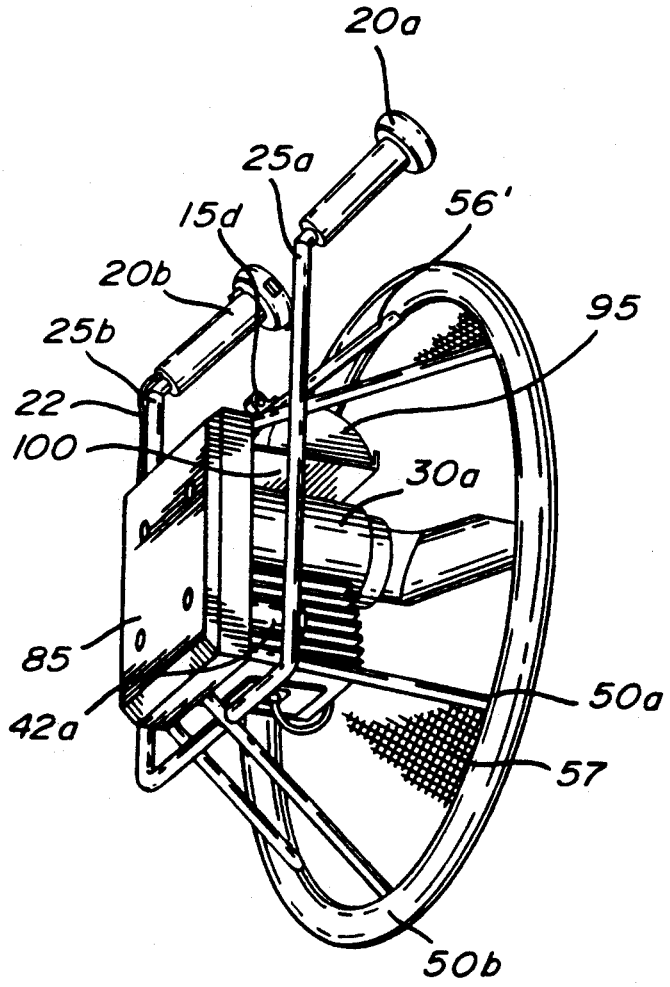
FIG. 9 is a perspective view of the propulsion apparatus shown in FIG. 8.
Figure 10:
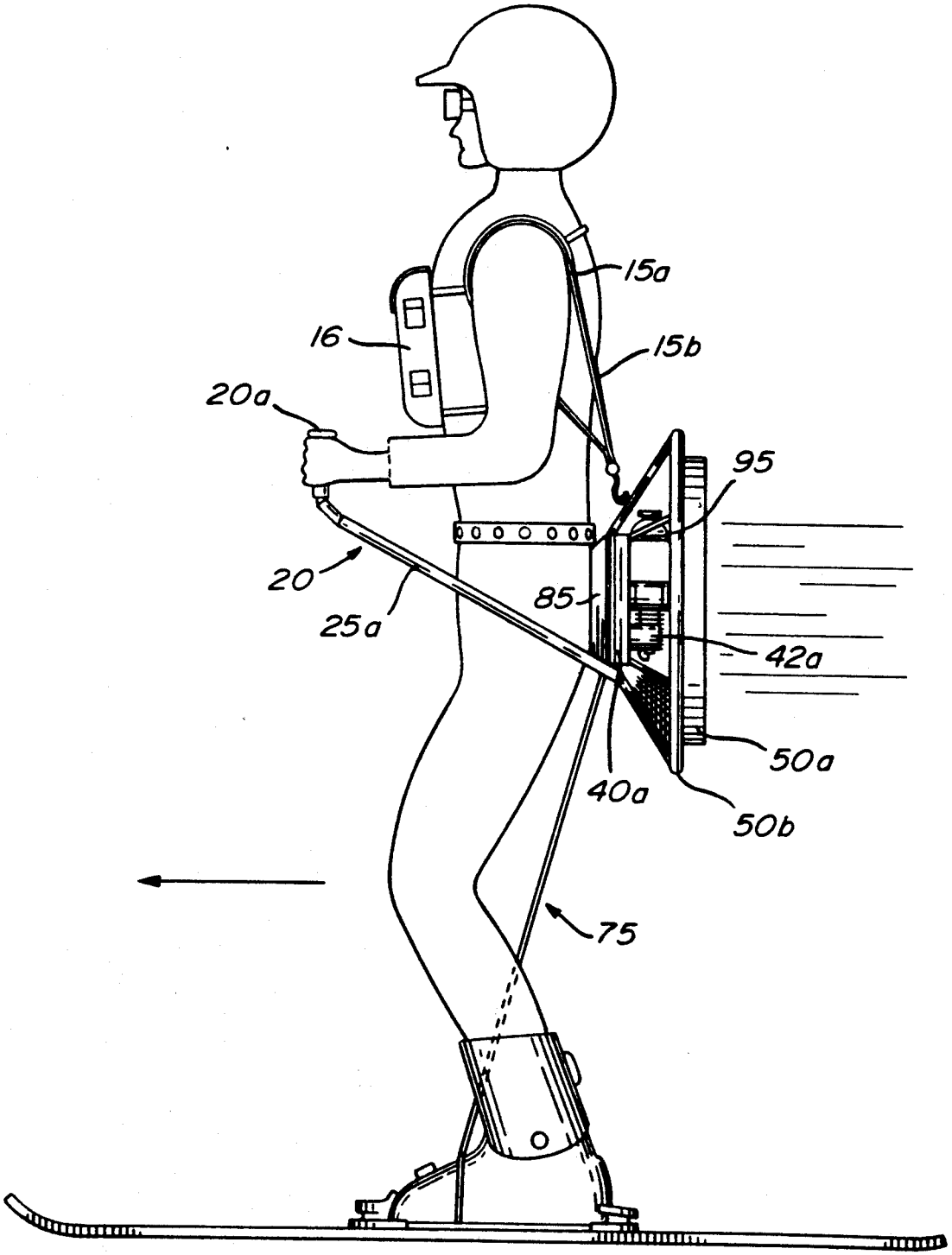
FIG. 10 a side elevational view of a skier using the propulsion apparatus shown in FIG. 8.

FIGS. 8, 9 and 10 illustrate a further embodiment of the present invention; in these figures the same reference numerals, as used in the previous figures, are used to identify the same elements of the illustrated apparatus. For the embodiment shown, the motor 30*a* is disposed upside down relative to the motor configuration of the other embodiment. This is done in order to allow the use of the separate fuel tank 95 which is of conventional tank design.

The fuel tank 95 is mounted to a platform 100 which is connected to the muffler-support structure 40*a*; the fuel tank 95 and the platform 100 may be fixed to the adjoining elements in any suitable fashion (e.g. nuts/-bolts, straps, welds, etc. . . . ).

The muffler-support structure 40*a* has exhaust outlets 42*a* and a corresponding exhaust manifold (not seen) but still retains the basic structure of muffler-support structure 40. However, since a separate fuel tank is used for this embodiment the muffler-support structure 40*a* may be replaced by a simple support plate structure and a separate muffler. In this case the motor may be attached to the support plate by a bracket so as to leave sufficient space between the motor and the plate for the insertion of the separate muffler therebetween, the muffler being operatively connected to the motor; the muffler may also be configured such that exhaust discharge may, as mention above, be directed into the path of the rotating propellor.

The fuel tank 95 is disposed within the cage structure 50. Since a separate fuel tank 95 is provided, the cage structure 50 is provided with an annular ring 50*b*.

The stems 25*a* and 25*b* of handle means are joined at their ends and the area of the joint passes through a hole in a rod element 105; one end of the rod element is fixed to or forms part of a rod 56 and the other end is fixed to the muffler-support structure 40*a*. The hole of the rod element 105 is configured to embrace the stem ends such that the handle means can pivot up and down but not side to side relative to the muffler-support structure 40*a*.

Since various modifications can be made to the invention as hereinabove described and many apparently widely different embodiments of same made within the spirit and scope of the claims without departing from such spirit and scope, it is intended that all matter contained in the accompanying specification shall be interpreted as illustrative only and not in a limiting sense. For example, an electric light can be added to the user for nocturnal uses.

I claim:

1. A propulsion apparatus for imparting thrust to a person, said thrust being transmitted solely to the rear of the pelvic area of said person, said propulsion apparatus comprising:

a support means for abutting solely the rear of the pelvic area of said person;

a power-operated means to said support means;

propelling means operatively connected to said power-operated means;

thrust variation means connected to said power-operated means; and securing means for securing said support means to said person such that the thrust imparted by said propulsion apparatus is transmitted solely to the rear of the pelvic area of said person, said power-operated means comprising a motor having a shaft, said propelling means comprising a propeller mounted to said shaft, said shaft having an axis of rotation which extends through the pelvic area of said person when said support means abutts said pelvic area said securing means comprising a pendulum shoulder harness, and said apparatus including handle means for allowing said person to manually pivot the apparatus about the pelvic area.

2. A propulsion apparatus according to claim 1, wherein said motor is an internal combustion motor, wherein said power-operated means includes a fuel tank for said motor and wherein said power-operated means includes muffler means having an exhaust discharge outlet means, said muffler means being configured and disposed such that exhaust discharge is directed toward said propeller.

3. A propulsion apparatus according to claim 2, wherein said support means includes said muffler means.

4. A propulsion apparatus for imparting thrust to a person, said thrust being transmitted solely to the rear of the pelvic area of said person, said propulsion apparatus comprising:

a support means for abutting solely the rear of the pelvic area of said person;

a power-operated means mounted to said support means;

propelling means operatively connected to said power-operated means;

thrust variation means connected to said power-operated means; and securing means for securing said support means to said person such that the thrust imparted by said propulsion apparatus is transmitted solely to the rear of the pelvic area of said person, said power-operated means comprising a motor having a shaft said propelling means comprising a propeller mounted to said shaft, said shaft having an axis of rotation which extends through the pelvic area of said person when said support means abutts said pelvic area, said securing means comprising a pendulum shoulder harness, said thrust variation means including handle means mounted to said support means for pivotal movement relative to said support means, said pivotal movement consisting of up and down movement, said handle mean being configured to extend from the support means to a position in front of and to the side of the abdominal area of the person.

5. A propulsion apparatus according to claim 4, wherein said motor is an internal combustion motor, wherein said power-operated means includes a fuel tank for said motor, and wherein said power-operated means includes muffler means having an exhaust discharge outlet means, said muffler means being configured and disposed such that exhaust discharge is directed toward said propeller.

6. A propulsion apparatus according to claim 5, wherein said support means includes said muffler means.

7. A propulsion apparatus according to claim 5, wherein said power-operated means includes foot-activated recoil starting means and said thrust variation means includes hand operable means, mounted on said handle means, for shutting off said power-operated means.

8. A propulsion apparatus for imparting thrust to a person, said thrust being transmitted solely to the rear of the pelvic area of said person, said propulsion apparatus comprising:

a support means for abutting solely the rear of the pelvic area of said person;

a power-operated means mounted to said support means;

propelling means operatively connected to said power-operated means;

thrust variation means connected to said power-operated means; and securing means for securing said support means to said person such that the thrust imparted by said propulsion apparatus is transmitted solely to the rear of the pelvic area of said person, said power-operated means comprising a motor having a shaft, said propelling means comprising a variable pitch propeller mounted to said shaft, said shaft having an axis of rotation which extends through the pelvic area of said person when said support means abutts said pelvic area said securing means comprising a pendulum shoulder harness, said thrust variation means including handle means mounted to said support means for pivotal movement relative to said support means, said pivotal movement consisting of up and down movement, said handle means being configured to extend from the support means to a position in front of and to the side of the abdominal area of the person, and said thrust variation means including variable pitch control means for controlling the pitch of said propeller.

9. A propulsion apparatus according to claim 8, wherein said power-operated means comprises an internal combustion motor and said power-operated means includes a fuel tank for said motor.

10. A propulsion apparatus according to claim 9, wherein said apparatus includes cowling cage means mounted to said support means, said power-operated means and said propelling means being disposed within said cage means.

11. A propulsion apparatus according to claim 10, wherein said fuel tank forms part of the cowling cage means.

12. A propulsion apparatus according to claim 10, wherein said power-operated means includes foot-activated recoil starting means and said thrust variation means includes hand operable means for shutting off said power-operated means.

13. A propulsion apparatus according to claim 8, wherein said power-operated engine comprises an electric motor.

* * * * *